US005244695A

United States Patent [19]

Davidowich et al.

[11] Patent Number: 5,244,695

[45] Date of Patent: Sep. 14, 1993

[54] AQUEOUS BINDER SATURANTS USED IN A PROCESS FOR MAKING NONWOVEN FILTERS

[75] Inventors: George Davidowich; John G. Iacoviello, both of Allentown; John S. Sadowski, Kutztown, all of Pa.

[73] Assignee: Air Products and Chemicals, Inc., Allentown, Pa.

[21] Appl. No.: 852,600

[22] Filed: Mar. 17, 1992

[51] Int. Cl.[5] ..... B05D 3/02

[52] U.S. Cl. ..... 427/389.9; 427/385.5; 427/391; 427/244; 428/224; 428/284; 428/290

[58] Field of Search ..... 524/503, 557; 428/224, 428/289, 290; 427/389.9, 385.5, 391, 244

[56] References Cited

U.S. PATENT DOCUMENTS

| | | | |
|---|---|---|---|
| 3,716,504 | 2/1973 | Lindemann et al. | 524/503 X |
| 3,907,958 | 9/1975 | Tsuji et al. | 524/503 X |
| 3,925,290 | 12/1975 | Matsuo et al. | 524/503 X |
| 4,189,415 | 2/1980 | Eck et al. | 524/503 X |
| 4,278,727 | 7/1981 | Brabetz et al. | 428/290 |
| 4,304,625 | 12/1981 | Grube et al. | 524/503 X |
| 4,528,315 | 7/1985 | Eck et al. | 524/503 X |
| 4,581,394 | 4/1986 | Yoshida et al. | 428/511 X |
| 4,605,589 | 8/1986 | Orphanides | 428/290 |
| 4,623,462 | 11/1986 | Urig et al. | 210/496 |
| 4,673,702 | 6/1987 | Iacoviello | 524/459 |
| 4,714,731 | 12/1987 | Iacoviello | 524/459 |
| 4,716,192 | 12/1987 | Iacoviello | 524/549 |
| 4,767,816 | 8/1988 | Iacoviello et al. | 524/459 |
| 4,999,239 | 3/1991 | Iacoviello et al. | 428/288 |
| 5,084,503 | 1/1992 | Iacoviello | 524/459 |
| 5,092,953 | 3/1992 | Derby et al. | 428/511 |

*Primary Examiner*—Joseph L. Schofer
*Assistant Examiner*—J. M. Reddick
*Attorney, Agent, or Firm*—Michael Leach; James C. Simmons; William F. Marsh

[57] ABSTRACT

A method for making a nonwoven filter which comprises impregnating a nonwoven filter substrate with a curable binder composition, the binder composition consisting essentially of (a) 10 to 100 wt% fully hydrolyzed PVOH which has a DPn of 100 to 2300; and (b) 0 to 90 wt% aqueous polymer emulsion, on a solids basis.

The preferred aqueous polymer emulsion is an ethylene-vinyl chloride (EVCl) copolymer emulsion or a vinyl acetate/-N-methylolacrylamide (VAc/NMA) copolymer emulsion, or both.

17 Claims, No Drawings

AQUEOUS BINDER SATURANTS USED IN A PROCESS FOR MAKING NONWOVEN FILTERS

TECHNICAL FIELD

The present invention relates to nonwoven filter substrates impregnated with aqueous binder compositions.

BACKGROUND OF THE INVENTION

The paper used as the filtration medium for automotive filters has been traditionally treated with phenolic resole type resins. This has been done to improve the paper's strength properties and to allow it to be pleated in an accordion-like shape and to hold the shape when the paper composite is cured. The standard phenolic resin used to treat automotive filter paper has relatively low mole ratios of formaldehyde to phenol so that good final paper properties, especially flexibility could be achieved. Higher mole ratio resins tend to result in brittle paper on curing.

The traditional method of making an automotive filter has been for the papermaker to treat a base filter sheet with an alcoholic solution of these phenolic resole resins. The treated sheet is passed through an oven to drive off the solvent and make a so-called B-stage sheet. This sheet is then shipped to the filter maker where it is pleated and put through an oven to further cure the sheet and to hold the shape of the pleats.

With the onset of greater concern for environmental quality, the filter manufacturers have requested paper suppliers to provide a formaldehyde-free or lower formaldehyde-containing impregnated sheet that holds its pleat and meets all of the requirements for oil filters. The paper suppliers have, in turn, requested resins suppliers to supply a water-based binder that provides performance at least comparable to that of the phenolic resole resins.

U.S. Pat. No. 4,623,462 discloses oil filters containing impregnated filter substrates which are impregnated with water-based binder comprising a latex containing at least 20% polymerized vinyl chloride in the latex solids, the latex being a homopolymer of a vinyl halide or a copolymer in which the vinyl halide is polymerized with other comonomers. The binder also contains 5 to 20 parts of cross-linking resin per 100 weight parts of latex solids and 5 to 20% catalyst for the cross-linking resin based on the weight of the cross-linking resin.

U.S. Pat. No. 4,999,239 discloses aqueous emulsions containing an ethylene-vinyl chloride copolymer and tetramethylol glycoluril for use as a binder composition suitable for application onto non-bonded filter paper. Filter paper impregnated with these emulsions maintained tensile strength and flexibility upon being subjected to hot oil.

U.S. Pat. No. 4,673,702; 4,714,731 and 4,716,192 disclose polyvinyl alcohol-stabilized vinyl chloride-ethylene copolymer emulsions as coatings for metal substrates.

U.S. 4,767,816 discloses an aqueous copolymer emulsion comprising a copolymer consisting essentially of vinyl chloride, ethylene and up to 10 wt. % hydroxyalkyl (meth)acrylate. The copolymer demonstrates improved solvent resistance and metal adhesion, especially to low energy films. It is suggested that the polyvinyl alcohol stabilized vinyl chloride-ethylene-hydroxyalkyl acrylate copolymer emulsions may also be used as a saturant binder for filter stock substrates.

SUMMARY OF THE INVENTION

Filters are made by impregnating or saturating filter paper or other suitable nonwoven substrate with a binder composition containing a fully hydrolyzed polyvinyl alcohol having a degree of polymerization (DPn) of 100 to 2300, especially a binder composition consisting essentially of:

(a) 10 to 100 wt. % fully hydrolyzed PVOH which has a DPn of 100 to 2300; and (b) 0 to 90 wt. % aqueous polymer emulsion, on a solids basis.

The preferred aqueous polymer emulsion is an ethylene-vinyl chloride (EVCl) copolymer emulsion or a vinyl acetate/-N-methylolacrylamide (VAc/NMA) copolymer emulsion, or both.

The use of such binder composition overcomes EPA and OSHA concerns of solvent (methanol, toluene and the like) and phenol issues when phenol-formaldehyde saturants are used and there is a great reduction of formaldehyde concentration. In addition, a single stage cure may only be necessary.

The filters demonstrate very good air permeability balanced with the required stiffness.

The filters demonstrate acceptable permeability (non-plugging of substrate), stiffness—either dry or hot oil stiffness, delamination, aqueous wet strength, and pleating stiffness with no brittleness.

DETAILED DESCRIPTION OF THE INVENTION

The present invention is directed to filters generally encompassing air, fuel, oil and vacuum filter media such as filter paper and other nonwovens, or both, impregnated with a cross-linkable aqueous binder composition. The resulting impregnated filter media have the necessary balance of permeability and other physical property requirements. The aqueous binder composition is preferably admixed with a cross-linking resin and a catalyst for the cross-linking resin before it is used to impregnate filter paper or a nonwoven filter substrate which is then dried and cured at an elevated temperature. The aqueous binder composition solids, prior to impregnation, are adjusted with water to a solids content of about 5 to 70%, preferably 10 to 30%, with the pH adjusted to about 4 to 12, preferably to pH 6 to 8.

The aqueous binder composition consists essentially of:

(a) 10 to 100 wt. % fully hydrolyzed PVOH having a DPn of 100 to 2300; and (b) 0 to 90 wt. % aqueous polymer emulsion.

A preferred binder composition for overall balanced properties and rheology consists essentially of:

(a) 30 to 70 wt. %, preferably about 50 wt. %, fully hydrolyzed PVOH having a DPn of 100 to 2300; and (b) 30 to 70 wt. %, preferably about 50 wt. %, aqueous polymer emulsion, based on solids.

The aqueous polymer emulsion is preferably an ethylene-vinyl chloride (EVCl) copolymer emulsion or a vinyl acetate/-N-methylolacrylamide (VAc/NMA) copolymer emulsion, or both. When both emulsions are present in the binder composition, they may be used in a 15:85 to 85:15, preferably a 50:50, weight ratio, based on solids.

The PVOH utilized in the present invention at 10 to 100 wt. % is fully hydrolyzed, i.e., at least 98 mole% hydrolyzed, preferably 98–99 mole% hydrolyzed, and has a DPn of 100 to 2300, preferably 335 to 605, i.e., a low molecular weight PVOH. A particularly suitable fully hydrolyzed low molecular weight PVOH for practicing the present invention is available from Air Products and Chemicals, Inc. as AIRVOL® 107 PVOH.

The EVCl emulsion comprises an aqueous colloidal dispersion containing 20 to 70% solids of a copolymer prepared by the aqueous emulsion polymerization of a monomer mixture sufficient to provide a copolymer consisting essentially of 65 to 90 wt. % vinyl chloride and 5 to 35 wt. % ethylene. The copolymer is prepared in the presence of a surfactant and/or protective colloid stabilizing system, preferably a stabilizing system consisting essentially of 3 to 15 wt. % PVOH which is preferably 70 to 91 mole% hydrolyzed.

The preferred emulsions contain 40 to 60% solids of a copolymer consisting essentially of 75 to 85 wt. % vinyl chloride and 15 to 25 wt. % ethylene prepared in the presence of a stabilizing system consisting essentially of 4 to 10 wt. % PVOH which is 85 to 89 mole% hydrolyzed.

The EVCl copolymers may optionally contain up to 10 wt. %, preferably about 1 to 5 wt. %, of a hydroxyalkyl- or carboxylic acid-containing functional comonomer which is copolymerizable with vinyl chloride and ethylene. The preferred functional comonomers are acrylic acid and $C_2$–$C_4$ hydroxyalkyl (meth)acrylates such as hydroxyethyl acrylate and hydroxypropyl acrylate.

The processes for preparing such PVOH-stabilized EVCl copolymer emulsions are taught in U.S. Pat. Nos. 4,673,702 and 4,767,816. Such EVCl copolymer emulsions are also marketed under the registered trademark AIRFLEX by Air Products and Chemicals, Inc.

The VAc/NMA copolymer emulsions comprise 40 to 65% solids of a copolymer prepared by the aqueous emulsion polymerization of a monomer mixture sufficient to provide a copolymer consisting essentially of 85 to 95 wt. % VAc and 15 to 4 wt. % NMA and may preferably contain 1–3 wt. % acrylic acid. Suitable VAc/NMA copolymer emulsions can be prepared according to the teachings in U.S. Pat. No. 3,770,680. A suitable VAc/NMA copolymer emulsion is commercially available from Air Products and Chemicals, Inc. under the trademark VINAC® 810L.

The aqueous binder compositions are prepared by simply blending the various components. For example, while stirring the aqueous PVOH solution (hot or cold), the emulsions can be added.

The polyester nonwovens, which can be used as a filter substrate, are generally sold in batt form which are made of fibers about 2.5 to 5 cm long and weigh about 6 to 600 g/m$^2$. Cellulosic substrates, such as filter paper, can also be used as a filter substrate. Paper that is eminently suitable for use as a filter substrate is bleached or unbleached filter paper weighing 30 to 180 g/m$^2$.

The aqueous binder composition of the present invention may be applied to the web or mat of fibers in any suitable fashion such as by spraying, dipping, roll-transferring, or the like. Application of the binder composition to the fibers is preferably made at room temperature to facilitate cleaning of the associated apparatus. The solids concentration of the binder is in the range of 10 to 60 wt. %, preferably from 10 to 35 wt. % when applied by dipping. When applied by roll-transfer, solids concentration of the binder composition is generally about 25 wt. % whereas with the spraying technique, it can range widely. The amount of binder, calculated on a dry basis, applied to the filter paper is that amount sufficient to bind the substrate together to form a self-sustaining web and typically ranges from about 3 to 50 wt. % of the filter substrate.

Preferably a cellulosic based filter media or other nonwoven substrate is saturated with the binder composition and the treated stock is dried for 8 minutes at 300° F. (149° C.) for a single stage cure. However, other time-temperature relationships can be employed as is well known in the art such as 150°–200° F. (66°–93° C.) for 5 to 10 minutes to promote film coalescence and distribution of the binder into the filter matrix. The dried stock is cured at 250°–350° F. (121°–177° C.) for 3 to 5 minutes or more.

Cross-linking resins well known in the art can be used to provide the desired degree of cross-linking of the polymers and render them stiffer and, in particular, more resistant to water and hot oil. The amount of cross-linking resin that can be suitably used is in the range of 1 to 33 weight parts, preferably 5 to 20 weight parts, per 100 weight parts of polymer solids. Examples of suitable cross-linking agents include water-dispersible or water-soluble resins, which, with the aid of a catalyst promote the cross-linking of the polymers. Examples of suitable cross-linking resins include emulsified epoxy resins, melamine-formaldehyde resins, urea-formaldehyde resins, lower alkoxy, lower melamine resins, phenol-formaldehyde resins, glyoxal, polyacrylate resins containing pendant unsaturation and other cross-linking resins.

Specific examples of a suitable melamine-formaldehyde resin that can be used to promote cross-linking of the polymers are Resimene 841 and Resimene AQ7550 resins available from Monsanto Company and Auramel 479 resin from Auralux Corp. To promote the action of the cross-linking resin, a suitable catalyst is used in an amount of 1 to 30 wt. % of the cross-linking resin, preferably 5 to 20 wt. %. Suitable catalysts include ammonium chloride, hydrochloride salt of 2-methyl-2-aminopropanol-1, sodium bisulfate, tri(dimethylaminoethyl)-phenol, and the like. Ammonium chloride is a useful acid catalyst for the melamine- and phenol-formaldehyde cross-linking resins, whereas 2-methylimidazole is an especially suitable catalyst in conjunction with the emulsified epoxy cross-linking resins.

In the following Examples 1–9, 80–90 lb/r filter base stock was impregnated with various binder compositions at 20 wt. % dry coat using an Atlas laboratory 2-roll saturator. Each impregnated sheet of filter base stock was dried and cured for eight minutes at 300° F. (149° C.) in an air circulating oven at a high velocity. The dried and cured sheets were then evaluated using the following standard tests:

Frazier Differential Pressure Air Permeability Machine: 5 mm orifice, felt side up Gurley stiffness: TAPPI T543pm-85
at RT, after hot oil 96 hr/300° F.
at 300° F., after hot oil 96 hr/300° F.

Tensile (Instron): comparable to TAPPI T494om-81
5" cmd × 1" md; wet tensile, 60 sec in 0.1% Aerosol OT/deionized water Table A shows the polymer composition of the various emulsions that were used in the following examples. Table B presents data about the various PVOH's used in the examples.

TABLE A

| EMULSIONS | |
|---|---|
| Emulsion (Tg °C.) | Polymer Composition |
| Airflex 4530 (30°) | EVCl/AAm (2.5%) |
| Airflex 4514 (14°) | EVCl/AAm (2.5%) |
| Airflex 4500 (0°) | EVCl/AAm (2.5%) |
| Rhoplex B88 (85°) | Acrylic |
| Airflex 7522DEV (24°) | PVOH (6%)/EVCl |
| Vinac 810L (41°) | VAc/NMA (8%)/AA (1%) |
| B (41°) | PVOH (6%)/EVCl/AA (10%)/NMA (2%) |
| C (37°) | PVOH (7%)/EVCl/HEA (8%) |
| D (27°) | PVOH (6%)/EVCl/AA (2%)/NMA (4%) |
| E (37°) | PVOH (6%)/EVCl/HPA (8%) |
| F (33°) | PVOH (6%)/EVCl/HEA (4%)/ Cymel 1172 (9%) |
| G (31°) | PVOH/VAc |
| H (17°) | PVOH/VAc/E |
| I (32°) | VAc |
| J (5°) | VAc/E/NMA (5%) |
| K (12°) | VAc/Acrylic |
| L (39°) | PVOH (6%)/EVCl/AA (10%)/HEA (2%) |
| M (32°) | PVOH (6%)/EVCl/HEA (8%) |
| N (28°) | PVOH (6%)/EVCl/AA (5%)/NMA (6%) |
| O (29°) | PVOH (7%)/EVCl |
| P (31°) | PVOH (7%)/EVCl/HEA (8%) |
| Q (32°) | EVCl/NMA (5%)/SLS (1.8%) |

PVOH - polyvinyl alcohol
AA - acrylic acid
NMA - N-methylolacrylamide
HEA - hydroxyethyl acrylate
AAm - acrylamide
EVCl - ethylene/vinyl chloride
E - ethylene
SLS - sodium lauryl sulfate
HPA - hydroxypropyl acrylate

TABLE B

| POLYVINYL ALCOHOLS | | | |
|---|---|---|---|
| Airvol PVOH | Mole % Hydrolysis | DPn | Mole Weight |
| Av-103 | 98+ | 155-290 | 13,000-23,000 |

TABLE B-continued

| POLYVINYL ALCOHOLS | | | |
|---|---|---|---|
| Airvol PVOH | Mole % Hydrolysis | DPn | Mole Weight |
| Av-107 | 98+ | 335-605 | 31,000-50,000 |
| Av-125 | 99.5+ | 1000-1500 | 85,000-130,000 |
| Av-165 | 99.5+ | 1600-2300 | 130,000-180,000 |
| Av-203 | 87-89 | 155-290 | 13,000-23,000 |
| Av-205 | 87-89 | 335-605 | 31,000-50,000 |
| Av-325 | 98+ | 1000-1500 | 85,000-130,000 |
| Av-425 | 95-96 | 1000-1500 | 85,000-130,000 |
| Av-603 | 79-81 | 155-290 | 13,000-23,000 |

EXAMPLE 1

This example compared the properties of filter substrate saturated with various polymer emulsions containing 15% Resimene AQ 7550 melamine-formaldehyde cross-linking agent. The standard control was a phenol-formaldehyde system. The goal was to devise an aqueous polymer emulsion binder composition that yields filter substrates demonstrating performance comparable to that of the phenol-formaldehyde system.

TABLE 1

| Binder Composition | Frazier Air % Loss | Gurley Stiffness, mg Initial R.T. | Hot Oil 300° F. | Hot Oil R.T., After | Tensile Dry (pli) | Tensile Wet (pli) |
|---|---|---|---|---|---|---|
| P-F Control[a] | 5 | 3992 | 3023 | 3245 | 28.0 | 16.4 |
| 100% Emulsion[b] | | | | | | |
| Vinac 810L | 0 | 4145 | 1278 | 3723 | 20.1 | 8.3 |
| K | 5 | 3089 | 815 | 2511 | 15.0 | 7.6 |
| I | 6 | 3834 | 1134 | 4134 | 21.3 | 9.3 |
| Airflex 4500 | 6 | 1511 | 984 | 1202 | 12.9 | 7.8 |
| Airflex 4514 | 6 | 1778 | 987 | 1415 | 14.4 | 8.7 |
| J | 8 | 1600 | 921 | 1400 | 17.5 | 9.5 |
| Airflex 4530 | 9 | 3378 | 1199 | 2689 | 17.6 | 10.2 |
| E | 10 | 4156 | 1745 | 3023 | 25.3 | 15.4 |
| G | 11 | 3779 | 1256 | 3845 | 25.5 | 11.5 |
| Rhoplex B88 | 11 | 2667 | 1683 | 2645 | 15.3 | 7.1 |
| C | 12 | 3989 | 1911 | 3434 | 24.8 | 15.2 |
| Airflex 7522 DEV | 14 | 3023 | 1554 | 2589 | 20.4 | 12.3 |
| H | 17 | 2345 | 1245 | 2112 | 23.4 | 8.6 |
| B | 19 | 3867 | 2178 | 3623 | 27.1 | 15.1 |
| F[c] | 19 | 3267 | 1682 | 2867 | 24.4 | 15.0 |
| D | 24 | 3123 | 1781 | 2378 | 23.4 | 14.7 |

[a]Phenol-formaldehyde resin binder
[b]Plus 15% Resimene AQ 7550 melamine-formaldehyde resin, D/D, low formaldehyde level
[c]Plus 9% Cymel 1172 trimethylolglycoluril + 1% Cycat 4040

The goal is to be in the range of the standard phenol-formaldehyde control system.

It can be seen from the data in Table 1 that, although several of the polymer emulsions when combined with the melamine-formaldehyde cross-linking agent gave a Frazier air permeability comparable to the phenol-formaldehyde control system, the hot oil Gurley stiffness and wet tensiles were dramatically inferior.

EXAMPLE 2

In this example, various PVOH's were blended with 15 wt. % Resimene AQ 7550 melamine-formaldehyde resin (M-F) and used as the saturant binder on paper filter substrate.

TABLE 2

| Binder Composition | Frazier Air % Loss | Gurley Stiffness, mg Initial R.T. | Hot Oil 300° F. | Hot Oil R.T., After | Tensile Dry (pli) | Tensile Wet (pli) |
|---|---|---|---|---|---|---|
| P-F Control | 5 | 3992 | 3023 | 3245 | 28.0 | 16.4 |
| 100% Polymer[a] | | | | | | |
| Vinac 810L | 0 | 4145 | 1278 | 3723 | 20.1 | 8.3 |

TABLE 2-continued

| Binder Composition | Frazier Air % Loss | Gurley Stiffness, mg Initial R.T. | Hot Oil 300° F. | Hot Oil R.T., After | Tensile Dry (pli) | Tensile Wet (pli) |
|---|---|---|---|---|---|---|
| Airflex 4514 | 6 | 1778 | 987 | 1415 | 14.4 | 8.7 |
| Airflex 4530 | 9 | 3378 | 1199 | 2689 | 17.6 | 10.2 |
| Airvol 107 | 10 | 4400 | 3615 | 4223 | 27.5 | 5.8 |
| Airvol 165 | 11 | 4723 | 3712 | 5145 | 34.5 | 12.0 |
| Airvol 125 | 16 | 4712 | 3934 | 5590 | 36.0 | 11.9 |
| Airvol 603 | 25 | 3754 | 2711 | 4634 | 24.3 | 3.1 |
| Airvol 325 | 33 | 4490 | 3879 | 5167 | 34.0 | 11.2 |
| Airvol 103 | 41 | 4634 | 3712 | 4645 | 25.5 | 4.6 |
| Airvol 203 | 45 | 4245 | 3334 | 4634 | 22.6 | 2.7 |
| Airvol 205 | 79 | 3500 | 3400 | 4089 | 27.8 | 3.9 |
| Airvol 425 | 92 | 4412 | 4289 | 5078 | 34.8 | 9.4 |

[a]Plus 15% M-F

The data in Table 2 demonstrates the superiority of Airvol 107 PVOH compared to other alcohol grades in air permeability. It had the best (lowest % loss) Frazier permeability value. Although Airvol 125 and 165 PVOH's also had relatively good Frazier air permeability, the high viscosities of their compositions make them less desirable.

EXAMPLE 3

In this example the PVOH-stabilized EVCl copolymer emulsion Airflex 7522 emulsion was blended 50:50 on a solids basis with various PVOH's. These blends were combined with 15 wt. % Resimene AQ 7550 melamine formaldehyde resin (M-F) and used as a saturant binder for the filter substrate.

TABLE 3

| Binder Composition | Frazier Air % Loss | Gurley Stiffness, mg Initial R.T. | Hot Oil 300° F. | Hot Oil R.T., After | Tensile Dry (pli) | Tensile Wet (pli) |
|---|---|---|---|---|---|---|
| P-F Control | 5 | 3992 | 3023 | 3245 | 28.0 | 16.4 |
| 100% Polymer[a] | | | | | | |
| Airflex 4530 | 9 | 3378 | 1199 | 2689 | 17.6 | 10.2 |
| Airvol 107 | 10 | 4400 | 3615 | 4223 | 27.5 | 5.8 |
| Airvol 165 | 11 | 4723 | 3712 | 5145 | 34.5 | 12.0 |
| Airflex 7522 DEV | 14 | 3023 | 1554 | 2589 | 20.4 | 12.3 |
| Airvol 125 | 16 | 4712 | 3934 | 5590 | 36.0 | 11.9 |
| Airvol 603 | 25 | 3754 | 2711 | 4634 | 24.3 | 3.1 |
| AIRFLEX 7522 DEV:PVOH (50:50)[a] | | | | | | |
| Airvol-107 | 7 | 3834 | 3089 | 3534 | 25.3 | 11.2 |
| Airvol-107 | 8 | 3600 | 2634 | 3200 | 24.8 | 10.7 |
| Airvol-125 | 11 | 4089 | 3456 | 4045 | 30.0 | 13.6 |
| Airvol-165 | 11 | 4212 | 3423 | 4212 | 31.1 | 14.6 |
| Airvol-603 | 70 | 3834 | 2601 | 3500 | 22.1 | 9.0 |

[a]Plus 15% M-F

It can be seen from Table 3 that paper treated with Airvol 107 PVOH and Airflex 7522 emulsion at 50:50 was in the same proximity of Frazier air permeability as the phenol-formaldehyde control while displaying similar Gurley stiffness. Though showing a slightly higher Frazier air loss, the use of Airvol 125 and 165 PVOH's with Airflex 7522 emulsion favorably gave higher initial, before hot oil and after hot oil Gurley stiffness and favorable wet tensile strength.

EXAMPLE 4

The data in Table 4 was taken from Table 3 and presented in a different format to show an unexpected and desirable synergistic effect on Frazier air permeability when using Airvol 107, 125 or 165 PVOH in combination with Airflex 7522 emulsion. Noteworthy is the obtained lower % loss of Frazier air permeablilty with Airvol 107 PVOH. In Table 4, the % synergy for Airvol 107 PVOH is a favorable decrease of −38%, Airvol 125 PVOH −27%, and Airvol 165 PVOH −12% compared to a highly unfavorable +159% for Airvol 603 PVOH.

TABLE 4

| % Loss, Frazier Air Permeability | | | | | |
|---|---|---|---|---|---|
| 100% Polymer | | | | 50:50%, Airvol:Airflex 7522 | % Synergy[a] |
| Airvol | + | A-7522 DEV | = Average | | |
| Airvol 107 / 10 | + | 14 | 12 | 7;8 | −38 |
| Airvol 125 / 16 | + | 14 | 15 | 11 | −27 |
| Airvol 165 / 11 | + | 14 | 12.5 | 11 | −12 |
| Airvol 603 / 25 | + | 14 | 19.5 | 70 | +159 |

[a] $\frac{100\% - 50{:}50\%,\ \%\ \text{Loss} \times 100}{100\%,\ \%\ \text{Loss}}$

EXAMPLE 5

This example demonstrates the improvement in filter binder compositions in which Airvol 107 PVOH was blended 50:50 with various polymer emulsions identified in Table A. The binder compositions also contained 15 wt. % melamine-formaldehyde resin (M-F).

TABLE 5

| Binder Composition | Frazier Air % Loss | Gurley Stiffness, mg Initial R.T. | Hot Oil 300° F. | Hot Oil R.T., After | Tensile Dry (pli) | Tensile Wet (pli) |
|---|---|---|---|---|---|---|
| P-F Control | 5 | 3992 | 3023 | 3245 | 28.0 | 16.4 |
| 100% Polymer[a] | 6 | 3834 | 1134 | 4134 | 21.3 | 9.3 |
| I | | | | | | |
| J | 8 | 1600 | 921 | 1400 | 17.5 | 9.5 |
| Airvol 107 | 10 | 4400 | 3615 | 4223 | 27.5 | 5.8 |
| Airflex 7522 DEV | 14 | 3023 | 1554 | 2589 | 20.4 | 12.3 |
| Emulsion:Airvol 107 (50:50)[a] | | | | | | |
| Vinac 810L | 0 | 3545 | 2289 | 3012 | 25.4 | 7.4 |
| I | 2 | 3778 | 2245 | 4134 | 23.7 | 8.6 |
| J | 4 | 2956 | 2523 | 3300 | 23.1 | 8.8 |
| K | 6 | 3267 | 2600 | 4045 | 25.0 | 7.1 |
| F | 7 | 4133 | 2956 | 3511 | 26.7 | 12.7 |
| Airflex 7522 DEV | 8 | 3690 | 2867 | 3556 | 26.1 | 11.9 |
| G | 8 | 4257 | 2735 | 4401 | 29.1 | 8.6 |
| C | 9 | 4312 | 3467 | 3978 | 27.1 | 13.1 |
| D | 9 | 4345 | 3100 | 3700 | 26.5 | 13.8 |
| H | 9 | 3412 | 2513 | 3489 | 26.4 | 7.1 |
| Airflex 4530 | 9 | 3556 | 2334 | 2878 | 23.3 | 12.5 |
| E | 10 | 3856 | 3323 | 3822 | 26.3 | 13.3 |
| B | 11 | 3945 | 3423 | 4190 | 27.1 | 14.5 |
| L | 13 | 3578 | 2545 | 3145 | 25.3 | 13.3 |
| Rhoplex B-88 | 16 | 3634 | 3123 | 3945 | 20.6 | 6.3 |

[a]Plus 15% M-F

The data in Table 5 also shows that the 50:50 blend of Airvol 107 PVOH and Vinac 810L emulsion resulted in no loss of Frazier air permeability which was superior to the phenol-formaldehyde control—equal to that of the unbonded oil filter substrate—but shows lower initial dry and hot oil Gurley stiffness values.

Table 5 shows the synergistic effect of PVOH, in this case Airvol 107 PVOH, with certain polymer emulsions. A few runs are shown with emulsions B, C, D, F and H and Airflex 7522 emulsion.

EXAMPLE 6

This example demonstrates aqueous binder compositions comprising three different polymer emulsions and Airvol 107 PVOH in various ratios.

TABLE 6

| Binder Composition | Frazier Air % Loss | Gurley Stiffness, mg Initial | Hot Oil 300° F. | Hot Oil R.T. After | Tensile Dry (pli) | Tensile Wet (pli) |
|---|---|---|---|---|---|---|
| P-F Control | 5 | 3992 | 3023 | 3245 | 28.0 | 16.4 |
| A-7522 DEV: Airvol 107[a] | | | | | | |
| 100:0 | 16 | 2723 | 1578 | 2378 | 23.4 | 15.6 |
| 70:30 | 11 | 3445 | 2601 | 2900 | 25.6 | 14.6 |
| 50:50 | 8 | 3690 | 2867 | 3556 | 26.1 | 11.9 |
| 30:70 | 9 | 4201 | 3067 | 4001 | 26.4 | 8.7 |
| 0:100 | 11 | 4478 | 3267 | 4223 | 26.0 | 5.5 |
| Emulsion M: Airvol 107[a] | | | | | | |
| 100:0 | 10 | 3178 | 1399 | 3878 | 21.8 | 12.7 |
| 70:30 | 8 | 3589 | 2067 | 3634 | 25.3 | 15.2 |
| 50:50 | 10 | 3689 | 2345 | 3613 | 28.5 | 13.5 |
| 30:70 | 8 | 3956 | 2978 | 3434 | 26.3 | 10.0 |
| 0:100 | 11 | 4478 | 3267 | 4223 | 26.0 | 5.5 |
| Vinac 810L: Airvol 107[a] | | | | | | |
| 100:0 | 0 | 4145 | 1278 | 3723 | 20.1 | 8.3 |
| 70:30 | 0 | 3489 | 1845 | 3078 | 24.8 | 7.7 |
| 50:50 | 0 | 3545 | 2289 | 3012 | 25.4 | 7.4 |
| 50:50[b] | 3 | 3789 | 2445 | 3756 | 26.9 | 9.9 |
| 30:70 | 0 | 3322 | 2600 | 3356 | 26.1 | 7.6 |
| 30:70[b] | 2 | 3778 | 2811 | 4290 | 27.3 | 10.5 |
| 0:100 | 14 | 4223 | 3808 | 4323 | 28.6 | 5.1 |

[a]Plus 15% M-F
[b]Plus 1% Cycat 4040 p-TSA

The data in Table 6 shows how the blending of Airvol 107 PVOH with the polymer emulsions maintained a favorable low percentage loss of Frazier air permeability while greatly enhancing the Gurley stiffness or wet tensile depending upon the ratio % of emulsion to A-107 PVOH, i.e., high levels of A-107 PVOH—enhanced Gurley stiffness and Frazier air permeability values; high levels of emulsion-enhanced wet tensile strength and, for Vinac 810L emulsion enhanced Frazier air permeability.

EXAMPLE 7

Various additives were evaluated in the aqueous binder compositions identified in Table 7. It can be seen that Strodex PK90 surfactant (potassium salt of phosphated coester of alcohol and aliphatic ethoxylate) demonstrated surprisingly superior results in the Frazier air permeability testing compared to the other additives. Strodex PK90 surfactant is available from Dexter Chemical Corp.

TABLE 7

| Binder Composition | Additive % dry basis | Frazier Air Permeability % Loss | Frazier Air Permeability % Improvement |
|---|---|---|---|
| Emulsion M:Airvol 107 (50:50)[a] | | | |
| No Additive | — | 11 | — |
| Strodex PK90 | 3 | 5 | 55 |
| 2-Ethyl-1-hexanol + Surfynol 440 (0.75 + 2.25) | 3 | 6 | 46 |
| Hypermer FP2 | 3 | 6 | 46 |
| Aerosol OT | 3 | 7 | 36 |
| Surfynol 440 | 3 | 7 | 36 |
| Span 20 | 3 | 7 | 36 |
| Tributyl Phosphate | 1 | 7 | 37 |
| Surfynol 61 | 3 | 8 | 27 |
| Tween 81 | 3 | 8 | 27 |
| Urea | 3 | 9 | 18 |
| Sodium sulfate | 3 | 9 | 18 |
| Glycerine | 3 | 9 | 18 |
| 2-Ethyl-1-hexanol | 3 | 9 | 18 |
| Sorbitol | 3 | 10 | 9 |
| Pluronic L62 | 3 | 11 | 0 |
| Tetrasodium Pyrophosphate | 3 | 11 | 0 |

TABLE 7-continued

| Binder Composition | Additive % dry basis | Frazier Air Permeability % Loss | Frazier Air Permeability % Improvement |
|---|---|---|---|
| A-7522 DEV:Airvol 107 (50:50)[a] | | | |
| No Additive | — | 11 | — |
| Strodex PK90 | 3 | 7 | 36 |
| Igepal CO 630 | 3 | 13 | (18) |
| Polystep OP3S | 3 | 14 | (27) |
| Tergitol NP 40 | 3 | 15 | (36) |

[a]Plus 15% M-F

EXAMPLE 8

This example shows the effect of various levels of Strodex PK90 surfactant in three different aqueous binder compositions comprising a polymer emulsion and Airflex 107 PVOH in a 50:50 weight ratio.

TABLE 8

| Binder Composition | Strodex PK90 % | Frazier Air % Loss | Gurley Stiffness, mg Initial | Gurley Stiffness, mg Hot Oil 300° F. | Gurley Stiffness, mg Hot Oil RT, After | Tensile Dry (pli) | Tensile Wet (pli) |
|---|---|---|---|---|---|---|---|
| Emulsion M: Airvol 107 (50:50)[a] | 0 | 11 | 3090 | 2345 | 2689 | 25.3 | 12 |
| | 0.5 | 9 | 3167 | 2400 | 2734 | 25.4 | 11 |
| | 1.5 | 7 | 3301 | 2312 | 2556 | 24.5 | 9.8 |
| | 3 | 5 | 3179 | 2424 | 2645 | 24.6 | 9.3 |
| | 5 | 9 | 3012 | 2150 | 2378 | 21.3 | 8.9 |
| Airflex 7522 DEV: Airvol 107 (50:50)[a] | 0 | 11 | 2934 | 2200 | 2623 | 24.8 | 10.6 |
| | 0.5 | 9 | 2912 | 2278 | 2545 | 23.9 | 9.3 |
| | 1.5 | 9 | 2823 | 2312 | 2556 | 22.8 | 8.6 |
| | 3 | 7 | 2722 | 2112 | 2334 | 21.4 | 8.1 |
| | 5 | 8 | 2556 | 1956 | 2156 | 20.5 | 7.4 |
| Emulsion N: Airvol 107 (50:50)[a] | 0 | 17 | 3067 | 2412 | 2556 | 23.8 | 13.9 |
| | 1.5 | 12 | 2800 | 2300 | 2467 | 22.2 | 12.3 |
| | 3 | 9 | 2978 | 2250 | 2389 | 22.3 | 11.6 |
| | 5 | 7 | 2834 | 2223 | 2245 | 22.1 | 11.1 |

[a]Plus 15% M-F

In the first two binder compositions a 3% level of Strodex PK90 surfactant favorably decreased the Frazier air % loss: however, a 5% level was required with the Emulsion N:Airvol 107 binder composition. Generally, the hot oil Gurley stiffness values were not appreciably affected. Wet tensiles decreased but were still acceptable.

EXAMPLE 9

This example demonstrates the performance of various binder compositions comprising an emulsion component and Airvol 107 PVOH in a 1:1 ratio, some of the binder compositions also containing 3% Strodex PK90 surfactant. (Ternary compositions are described in footnote c.) In the last two examples of Table 9 the emulsion component of the binder composition was a 1 1 blend of the two identified emulsions.

TABLE 9

| Emulsion:Airvol-107 (50:50)[a] | Frazier Air % Loss | Gurley Stiffness, mg Initial | Gurley Stiffness, mg Hot Oil 300° F. | Gurley Stiffness, mg Hot Oil RT, After | Tensile Dry (pli) | Tensile Wet (pli) |
|---|---|---|---|---|---|---|
| M:Vinac 810L[b,c] (1:1) | 6 | 3434 | 2478 | 3134 | 23.0 | 7.2 |
| M | 11 | 3090 | 2345 | 2689 | 25.3 | 12.0 |
| N[b] | 8 | 2978 | 2256 | 2389 | 22.3 | 11.6 |
| Q[b] | 8 | 3323 | 2256 | 2734 | 22.1 | 9.7 |
| Airflex 7522 DEV: Vinac 810L[b,c] (1:1) | 6 | 3256 | 2234 | 2756 | 23.9 | 7.2 |
| P[b] | 6 | 3101 | 2032 | 2423 | 23.1 | 10.0 |
| 100% Airflex 7522 DEV | 11 | 2934 | 2200 | 2623 | 24.8 | 10.6 |

TABLE 9-continued

| Emulsion:Airvol-107 (50:50)[a] | Frazier Air % Loss | Gurley Stiffness, mg Initial | Hot Oil 300° F. | Hot Oil RT, After | Tensile Dry (pli) | Tensile Wet (pli) |
|---|---|---|---|---|---|---|
| O[b] | 6 | 2778 | 2020 | 2345 | 21.7 | 9.3 |

[a]Plus 15% M-F
[b]Plus 3% Strodex PK90
[c]50 parts A-107, 25 parts PVOH/EVCl emulsion and 25 parts Vinac 810L The two ternary compositions presented the best balance of lowest Frazier air % loss, hot Gurley stiffness value and wet tensile.

STATEMENT OF INDUSTRIAL APPLICATION

The invention provides aqueous-based polymeric compositions suitable as saturant binders for air, fuel, oil and vacuum filter substrates.

We claim:

1. In a method for making a permeable nonwoven filter which comprises impregnating a nonwoven filter substrate with a curable binder composition, the improvement which comprises employing an aqueous binder composition consisting essentially of 10 to 100 wt. % of a polyvinyl alcohol which is at least 98 mole % hydrolyzed and has a degree of polymerization of 100 to 2300.

2. The method of claim 1 in which the polyvinyl alcohol has a degree of polymerization of 335 to 605.

3. The method of claim 1 in which the polyvinyl alcohol is 98–99 mole % hydrolyzed.

4. The method of claim 1 in which the polyvinyl alcohol is 99.5+ mole % hydrolyzed.

5. In a method for making a permeable nonwoven filter which comprises impregnating a nonwoven filter substrate with a curable binder composition, the improvement which comprises employing an aqueous binder composition consisting essentially of (a) 10 to 100 wt. % polyvinyl alcohol which is at least 98 mole % hydrolyzed and has a degree of polymerization of 100 to 2300; and (b) 0 to 90 wt. % aqueous polymer emulsion, based on solids.

6. The method of claim 5 in which the polymer emulsion comprises an ethylene-vinyl chloride copolymer emulsion.

7. The method of claim 5 in which the polymer emulsion comprises a vinyl acetate/N-methylolacrylamide copolymer emulsion.

8. The method of claim 5 in which the polyvinyl alcohol is 98–99 mole % hydrolyzed and has a degree of polymerization of 335 to 605.

9. The method of claim 5 in which the polyvinyl alcohol is 99.5+ mole % hydrolyzed.

10. The method of claim 6 in which the polymer emulsion also comprises a vinyl acetate/N-methylolacrylamide copolymer emulsion.

11. In a method for making a nonwoven filter which comprises impregnating a nonwoven filter substrate with a curable binder composition, the improvement which comprises employing an aqueous binder composition consisting essentially of (a) 30 to 70 wt. % polyvinyl alcohol which is at least 98 mole % hydrolyzed and has a degree of polymerization of 335 to 605; and (b) 30 to 70 wt. % aqueous polymer emulsion, based on solids, which polymer emulsion comprises an ethylene-vinyl chloride copolymer emulsion or a vinyl acetate/N-methyloleacrylamide copolymer emulsion, or both.

12. The method of claim 11 in which the polymer emulsion comprises an ethylene-vinyl chloride copolymer emulsion.

13. The method of claim 12 in which the ethylene-vinyl chloride copolymer emulsion is prepared using a stabilizing system comprising a 70 to 91 mole % hydrolyzed polyvinyl alcohol.

14. The method of claim 13 in which the polymer emulsion also comprises a vinyl acetate/N-methylolacrylamide copolymer emulsion.

15. The method of claim 11 in which the binder composition consists essentially of 70 wt. % of the polyvinyl alcohol and 30 wt. % of the polymer emulsion.

16. The method of claim 14 in which the binder composition consists essentially of 70 wt. % of the polyvinyl alcohol and 30 wt. % of the polymer emulsion.

17. The method of claim 16 in which the polymer emulsion comprises a 50:50 weight ratio of the ethylene-vinyl chloride copolymer emulsion and the vinyl acetate/N-methylolacrylamide copolymer emulsion.

* * * * *